US009641953B2

(12) United States Patent
Pallone et al.

(10) Patent No.: US 9,641,953 B2
(45) Date of Patent: May 2, 2017

(54) SOUND SPATIALIZATION WITH ROOM EFFECT, OPTIMIZED IN TERMS OF COMPLEXITY

(71) Applicant: ORANGE, Paris (FR)

(72) Inventors: Gregory Pallone, Betton (FR); Marc Emerit, Rennes (FR)

(73) Assignee: Orange, Paris (FR)

( * ) Notice: Subject to any disclaimer, the term of this patent is extended or adjusted under 35 U.S.C. 154(b) by 0 days.

(21) Appl. No.: 15/029,458

(22) PCT Filed: Oct. 14, 2014

(86) PCT No.: PCT/FR2014/052617
§ 371 (c)(1),
(2) Date: Apr. 14, 2016

(87) PCT Pub. No.: WO2015/055946
PCT Pub. Date: Apr. 23, 2015

(65) Prior Publication Data

US 2016/0269850 A1 Sep. 15, 2016

(30) Foreign Application Priority Data

Oct. 18, 2013 (FR) ..... 13 60185

(51) Int. Cl.
*H04S 7/00* (2006.01)
*G10L 19/008* (2013.01)
*G10K 15/12* (2006.01)

(52) U.S. Cl.
CPC ..... *H04S 7/307* (2013.01); *G10K 15/12* (2013.01); *G10L 19/008* (2013.01); *H04S 7/306* (2013.01); *H04S 2400/01* (2013.01); *H04S 2420/01* (2013.01); *H04S 2420/07* (2013.01)

(58) Field of Classification Search
None
See application file for complete search history.

(56) References Cited

U.S. PATENT DOCUMENTS

| | | | | |
|---|---|---|---|---|
| 5,917,917 | A | 6/1999 | Jenkins et al. | |
| 2008/0085008 | A1 | 4/2008 | Vickers | |
| 2011/0170721 | A1* | 7/2011 | Dickins | H04S 7/306 381/309 |
| 2012/0201389 | A1 | 8/2012 | Emerit et al. | |

FOREIGN PATENT DOCUMENTS

FR 1 357 299 A 4/1964

* cited by examiner

*Primary Examiner* — Curtis Kuntz
*Assistant Examiner* — Kenny Truong
(74) *Attorney, Agent, or Firm* — Drinker Biddle & Reath LLP

(57) ABSTRACT

A sound spatialization, with the application of at least one transfer function with room effect to at least one sound signal. This application amounts to multiplying, in the spectral range, spectral components of the sound signal by the spectral components of a filter corresponding to the transfer function, each spectral component of the filter having a temporal evolution in a time-frequency representation. In particular, the spectral components of the filter are especially ignored, for the above-mentioned multiplications of components, beyond a threshold frequency and after at least a given instant in said time-frequency representation.

9 Claims, 5 Drawing Sheets

SOUND SPATIALIZATION WITH ROOM EFFECT, OPTIMIZED IN TERMS OF COMPLEXITY

CROSS-REFERENCE TO RELATED APPLICATIONS

This application is the U.S. national phase of the International Patent Application No. PCT/FR2014/052617 filed Oct. 14, 2014, which claims the benefit of French Application No. 13 60185 filed Oct. 18, 2013, the entire content of which is incorporated herein by reference.

BACKGROUND

The present invention relates to sound spatialization with room effect.

The invention finds an advantageous but non-limiting application in the processing of sound signals respectively issuing from L channels associated with virtual speakers (for example in a multi-channel representation, or in a surround-sound representation, of the sound to be rendered), for spatialized rendering on real speakers (for example two earpieces of a headset in binaural rendering, or two separate speakers in transaural rendering).

For example, the signal from one of these channels can be processed to have a first contribution in the left earpiece and a second contribution in the right earpiece in binaural rendering, in particular by applying a transfer function with room effect to each of these contributions. The application of these transfer functions with room effect then contributes to providing the listener with a feeling of immersion, as if the virtual speaker associated with that channel is "positioned" relative to the listener.

In one particular embodiment, described in particular in document FR13 57299, a transfer function with room effect is applied to each sound signal of a corresponding channel in the time domain, in the form of a BRIR-type of impulse response ("Binaural Room Impulse response"). In particular, in that document which is incorporated herein by reference, the BRIR transfer function is constructed as a combination of:

- a first transfer function specific to each signal, and
- a second, general transfer function, common to all signals and characterizing in particular a reverberant field, the presence of the latter usually occurring in a room after a certain amount of time, typically after the first reflections of a sound wave.

Such an embodiment advantageously allows applying processing common to all signals, which physically corresponds in actuality to a "blend" of acoustic waves as reverberations occur, therefore after a certain amount of time (characterizing the beginning of the presence of the reverberant field). Such an embodiment reduces the complexity of spatialization processing with room effect on multiple initial channels.

However, in modules with spatialization occurring prior to rendering, there is a desire to further minimize the complexity of spatialization processing. As a non-limiting example, the signals of the channels are received in encoded form by a compression decoder. This decoder sends the signals of the channels, once decoded, to a spatialization module for rendering the sound with room effect on two speakers. It is then desirable that the processing in this spatialization step (which follows the decoding of the received signals) be of reduced complexity so that it does not slow down all the decoding and spatialization steps when the signals are received prior to rendering.

SUMMARY

The present invention improves the situation.

For this purpose, the invention proposes reducing the complexity of the application of the transfer function with room effect, in particular by reducing this complexity in the spectral range. In the spectral range, convolution by a transfer function becomes a multiplication of the spectral components of a signal, by a filter representing the transfer function (FIG. 1 described in further detail below).

The invention is based on the advantageous observation that, after direct propagation, a sound wave tends to attenuate in the high frequencies because of the progressive reflections on surfaces (typically walls, the listener's face, etc.) which absorb the wave, particularly in the high frequencies. In addition, the air itself absorbs the spectral components of the highest frequencies of sound during its propagation. This phenomenon is further increased for example for a reverberant field, for which it is unnecessary to have a frequency representation for very high frequencies (for example above a frequency range of 5 to 15 kHz).

It is thus possible to reduce the processing complexity when applying the transfer function with room effect, in the spectral range, simply by not taking into account components associated with frequencies greater than a predetermined cutoff frequency (for example greater than 5 to 15 kHz), when multiplying the aforementioned spectral components.

The invention therefore concerns a method for sound spatialization, comprising the application of at least one transfer function with room effect to at least one sound signal, said application amounting to multiplying, in the spectral range, spectral components of the sound signal by the spectral components of a filter corresponding to said transfer function. Each spectral component of the filter has a temporal variation in a time-frequency representation (as further detailed with reference to FIG. 3).

In particular, these spectral components of the filter are ignored, for the abovementioned multiplications of components, beyond a threshold frequency and after at least a given instant in said time-frequency representation. Thus, after this given instant, the spectral components of the filter are taken into account up to a cutoff frequency that can be chosen for example to be between 5 and 15 kHz (depending on the room effect to be applied and/or on the signal to be spatialized, as described below). Beyond the cutoff frequency, the multiplication is not even carried out, which is mathematically the same as multiplying the signal by zero.

This given instant typically represents the moment when a sound wave begins to undergo reverberation (by successive reflections, or, later on, from the presence of a reverberant sound field). Thus, in general terms, in an embodiment where the transfer function takes into account reverberations in the room effect (for example, taking into account the reverberant field), said given instant may be chosen as a function of such reverberations. For example, in room effect reverberations, said given instant may be subsequent to a direct sound propagation with the initial reflections, and thus corresponds to the beginning of the presence of the reverberant sound field.

Furthermore, an embodiment may be provided in which the abovementioned threshold frequency decreases over time in said time-frequency representation. For example, if the signal is sampled in several successive temporal blocks, it may be arranged for example to preserve the spectral components present in the signal, in the multiplication of components, for a first block, then to ignore them beyond a first threshold frequency for a second block which follows the first block, then to ignore them beyond a second threshold frequency for a third block which follows the second block, etc., the second threshold frequency being lower than the first.

Thus, in more general terms, in an embodiment where the signal is sampled in several successive blocks, the spectral components of the filter can be ignored for the multiplication of the components:

beyond a first threshold frequency for a given block, then, beyond a second threshold frequency for a block which follows the given block, the second threshold frequency being lower than the first threshold frequency.

Said given block may include, for example, samples temporally positioned at times which correspond to moments when a sound wave has undergone one or more reflections, even with the beginning of the presence of the reverberant sound field. The block which follows said given block (immediately or several blocks later) may include, for example, samples temporally located after or starting with the beginning of the presence of the reverberant sound field.

Such an embodiment allows, for example, reducing possibly audible artifacts from signal attenuation in the high frequencies for reverberations, this embodiment being accomplished progressively over several blocks. It also allows considering multiple forms of transfer functions (denoted below as $B_{mean}^{k}(m)$, where m is a block index) characterizing a reverberant sound field. It is possible for example to apply a transfer function $B_{mean}^{k}$ to said given block, and to apply a temporally progressive cutoff window ("fade out" type window) to this transfer function $B_{mean}^{k}$ for the following block, in order to "end" the presence of the reverberant sound field.

In an embodiment where the method is implemented by a sound spatialization module receiving a plurality of input signals and providing at least two output signals, in order to provide each output signal, a transfer function with room effect is applied to each input signal, each of said output signals being given by applying a formula of the type:

$$O^k = \sum_{l=1}^{L} \left(I(l) *_{[0;\ldots;f^k(l)]} A^k(l)\right) + \sum_{m=1}^{M} \left(z^{-iDDm} \cdot G(I(l)) \cdot \sum_{l=1}^{L} \left(\frac{1}{W^k(l)} \cdot I(l)\right)\right) *_{[0;\ldots;f^k(m)]} B_{mean}^{k}(m)$$

$O^k$ being an output signal, and k being the index relating to an output signal, $l \in [1; L]$ being the index relating to an input signal among said input signals, L being the number of input signals, and I(l) being an input signal among said input signals, $A^k(l)$ being a transfer function with room effect, specific to an input signal, $B_{mean}^{k}(m)$ being a general transfer function, with room effect, common to the input signals, $W^k(l)$ being a selected weighting factor, and G(I(l)) being a predetermined power compensation gain, $z^{-iDDm}$ being an application of a delay, counted as the number of blocks of samples, corresponding to a time difference between emission of a sound in a room corresponding to the room effect, and the beginning of the presence of the reverberant field in said room, the index m corresponding to a number of blocks of samples of a duration corresponding to this delay, M being the total number of blocks that a transfer function lasts in a time-frequency representation, the symbol "." designating multiplication, the term "$*[0; \ldots; f^k(l)]$" designating the convolution operator on a limited number of frequencies and ranging from a lowest frequency to a maximum frequency $f^k(l)$ which is a function of at least the input signal of index l, and the term "$[0; \ldots; f^k(m)]$" designating the convolution operator on a limited number of frequencies and ranging from a lowest frequency to a frequency $f^k(m)$ which is a function of the block of samples of index m.

This embodiment will be described in detail below with reference to FIGS. 2 and 5 in particular.

One can also limit the multiplication calculations beyond a first threshold frequency, starting with the first block or blocks of samples, based on the signal characteristics (for example its sampling frequency, or the highest frequency represented in the spectral components of the signal), or based on applied spatialization characteristics (for example with limitation of high frequency components for a contralateral acoustic path as detailed below).

In this case, the signal from reverberations (after reflection or in the reverberant field) does not normally include spectral components of a frequency higher than the initial signal. The abovementioned threshold frequency thus cannot be greater than this highest frequency.

In more general terms, in one embodiment, information is obtained about the spectral component of highest frequency in the sound signal, and the abovementioned threshold frequency is chosen as the minimum between a predetermined threshold frequency (for example between 5 and 15 kHz) and said highest frequency.

Typically, in an embodiment where the sound signal originates from a compression decoder, the information about the spectral component of highest frequency may be provided by the decoder.

Similarly, if the spatialization is performed in a module able to support different signal formats, especially in terms of the sampling frequency of such signals, said highest frequency cannot be greater than half the sampling frequency, and thus the threshold frequency for implementing the invention may also be selected based on this sampling frequency.

In an embodiment where the sound signal is spatialized on at least first and second virtual speakers, respectively associated with a first and a second channel, first and second transfer functions with room effect are respectively applied to said first and second channels, as explained above in the introduction (for example by adapting signals on surround-sound channels to switch to a binaural or transaural rendering). In particular, in the case where one among the first and second transfer functions applies an ipsilateral acoustic path effect, while the other among the first and second transfer functions applies a contralateral acoustic path effect, an elimination of spectral components of the sound signal that are beyond a given screening frequency may be provided. This "screening" frequency is explained by the fact that, for a contralateral path between a virtual speaker and the ear concerned of the listener, the listener's head lies in the acoustic path and absorbs the higher pitches of the acoustic wave (thus eliminating the spectral components associated with the higher frequencies of the acoustic wave). Thus, for the transfer function applying a contralateral path effect, said threshold frequency can be selected as the minimum between a predetermined threshold frequency (for example chosen between 5 and 15 kHz) and said screening frequency. This embodiment is advantageous when applied even for the first block of samples. However, this does not exclude the possibility of increasing the threshold frequency again for the next block, to simulate a first reflection on a wall facing the ear in question, such a first reflection being received by that ear via an ipsilateral path.

In any event, it is understood that the cutoff frequency may be chosen as common to all signals, in one possible embodiment, after a given instant which corresponds for example to the presence of the reverberant field.

Thus, the embodiment described in document FR13 57299 introduced above can be advantageous in the context of the invention, particularly if each transfer function applied to a signal comprises:

a transfer function specific to this signal, added to a general transfer function, common to all signals and representative of the presence of the reverberant field, then said given instant can be common to all signals and correspond for example to the beginning of the presence of the reverberant sound field.

In an embodiment where the signals comprise successive blocks of samples, of the same size between signals, at least one given instant is provided for limiting the inclusion of frequency components up to a cutoff frequency, said given instant being temporally located at the beginning of a block that is different from a first block in a sequence of blocks. This given instant therefore occurs after a direct propagation, and at the time of sound reflections or of the presence of the reverberant field.

This embodiment will be detailed below with reference to FIG. 5, also illustrating, in one exemplary embodiment, a possible algorithm of a computer program to be executed by a processor of a spatialization module carrying out the method in the sense of invention. In this respect, the invention also relates in general to a computer program comprising instructions for implementing the above method, when executed by a processor.

The invention also concerns a sound spatialization module, comprising a processor for applying at least one transfer function with room effect to at least one input sound signal, said application amounting to multiplying, in the spectral range, spectral components of the sound signal by the spectral components of a filter corresponding to said transfer function, each spectral component of the filter having a temporal evolution in a time-frequency representation. In particular, this processor is configured to ignore said spectral components of the filter for said multiplications of components, beyond a threshold frequency and after at least a given instant in said time-frequency representation.

The sound spatialization module, receiving a plurality of input signals, provides at least two output signals, the processor being configured to apply a transfer function with room effect to each input signal, each of said output signals being given by applying a formula of the type:

$$O^k = \sum_{l=1}^{L} \left( I(l) *_{[0;\ldots;f^k(l)]} A^k(l) \right) +$$

-continued $$\sum_{m=1}^{M} \left( z^{-iDDm} \cdot G(I(l)) \cdot \sum_{l=1}^{L} \left( \frac{1}{W^k(l)} \cdot I(l) \right) \right) *_{[0;\ldots;f^k(m)]} B^k_{mean}(m)$$

$O^k$ being an output signal, and k being the index relating to an output signal, l ∈[1; L]being the index relating to an input signal among said input signals, L being the number of input signals, and I(l) being an input signal among said input signals, $A^k(l)$ being a transfer function with room effect, specific to an input signal, $B^k_{mean}(m)$ being a general transfer function, with room effect, common to the input signals, $W^k$being a selected weighting factor, and G(I(l)) being a predetermined power compensation gain, $z^{-iDDm}$being an application of a delay, counted as the number of blocks of samples, corresponding to a time difference between emission of a sound in a room corresponding to the room effect, and the beginning of the presence of the reverberant field in said room, the index m corresponding to a number of blocks of samples of a duration corresponding to this delay, M being the total number of blocks that a transfer function lasts in a time-frequency representation, the symbol "." designating multiplication, the term "*[0; . . . ;$f^k$(l)]" designating the convolution operator on a limited number of frequencies and ranging from a lowest frequency to a maximum frequency $f^k$(l) which is a function of at least the input signal of index l, and the term "*[0; . . . ;$f^k$(m)]" designating the convolution operator on a limited number of frequencies and ranging from a lowest frequency to a frequency $f^k$(m)which is a function of the block of samples of index m.

This module can be integrated into a compression decoding device, or more generally into a rendering system.

Such a spatialization module SPAT is represented in FIG. 6, as well as a decoding device DECOD which receives from a network RES, in the example represented, compression-encoded signals I'(/) (where I=1, . . . , L) and decodes them prior to rendering, sending the decoded signals I(/) (where I=1, . . . , L) to the spatialization module. In the example represented, the latter module comprises an input interface IN for receiving the decoded signals, and calculation means such as a processor PROC and a working memory MEM cooperating with the interfaces IN/OUT in order to spatialize the signals I(/) and deliver via the output interface OUT only two signals $O^d$ and $O^g$ intended to be supplied to the respective earpieces of a headset CAS.

BRIEF DESCRIPTION OF THE DRAWINGS

Other features and advantages of the invention will become apparent from the following detailed description and from the accompanying drawings, in which.

DETAILED DESCRIPTION

Figure 1:
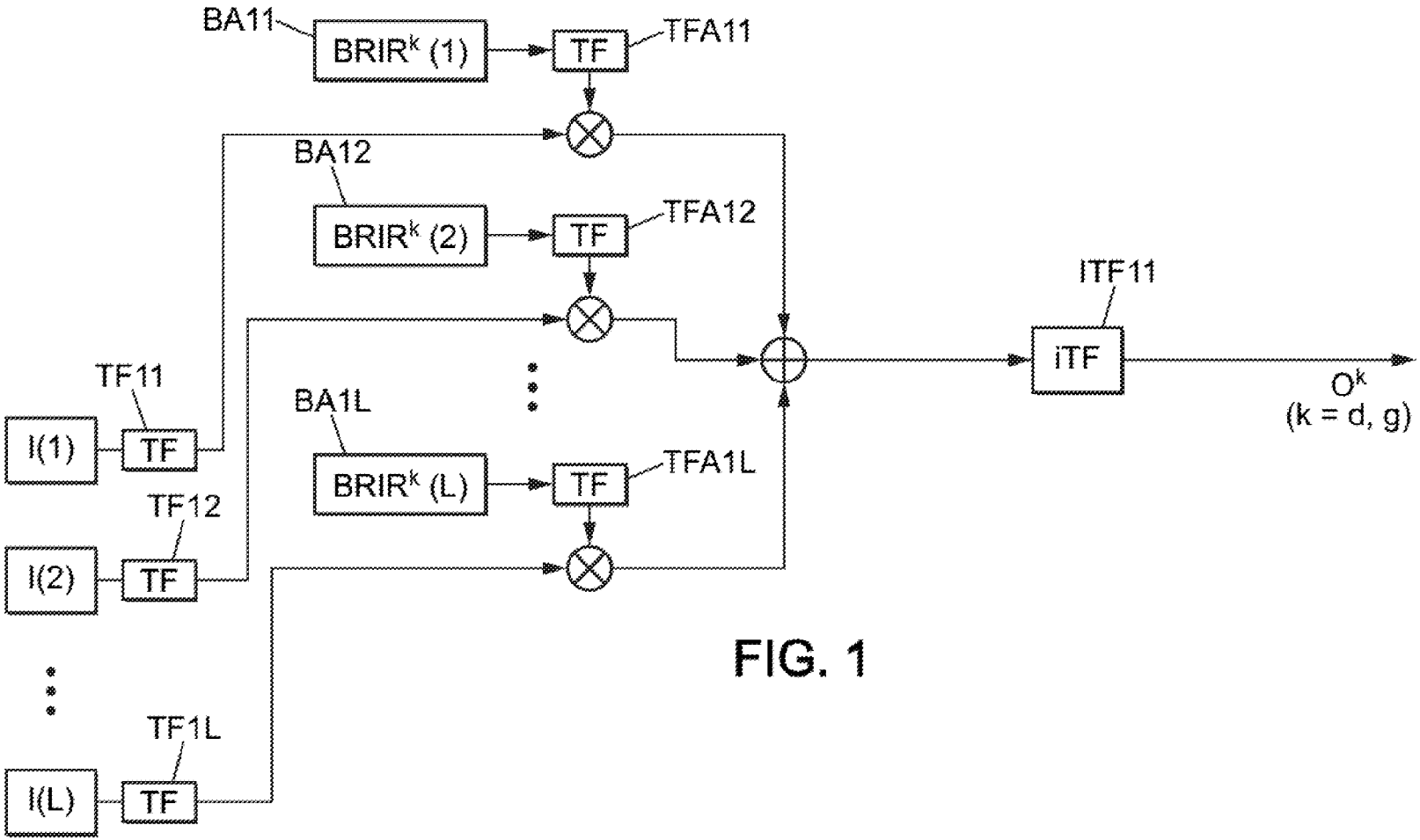
FIG. 1 illustrates a general embodiment of the method of the invention.
Figure 7:
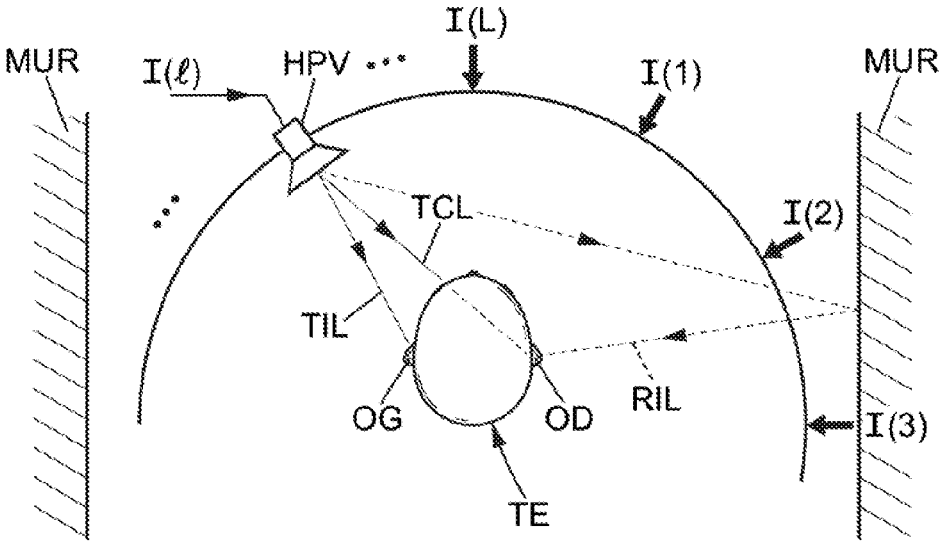
FIG. 7 schematically illustrates the virtual loudspeakers and the room effect when applying an appropriate transfer function, with limitation of the frequency components of said transfer function up to a suitable cutoff frequency.

Before describing FIG. 1 and the general principles of the invention, we will refer to FIG. 7 to explain the underlying physical phenomena of the invention.

Figure 6:
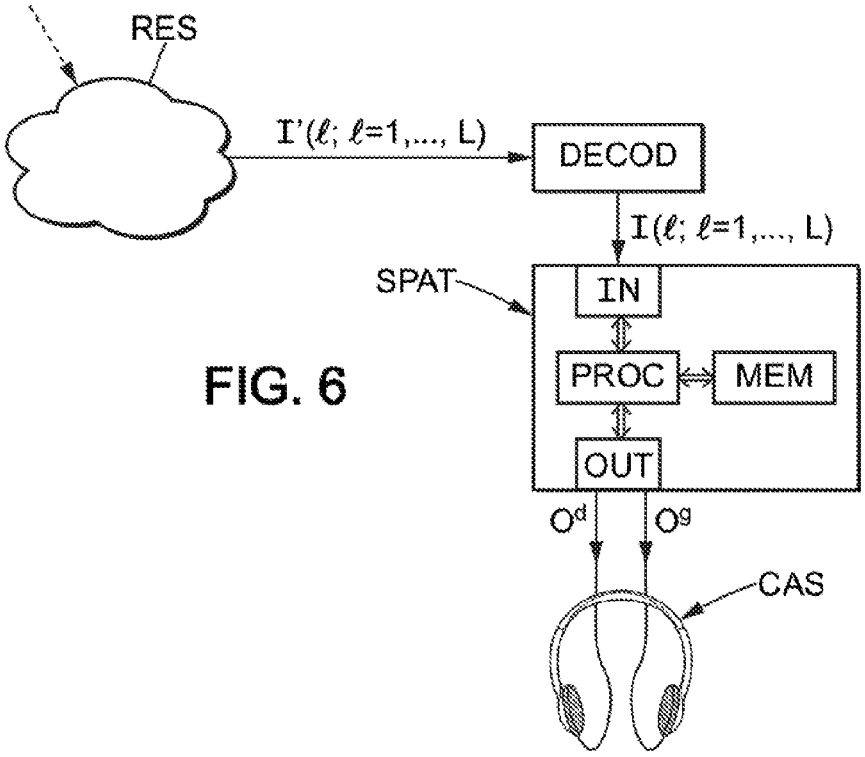
FIG. 6 shows an example of a spatialization module in the sense of the invention.

In the example shown, a plurality of virtual speakers surround the head TE of a listener. Each of the virtual speakers HPV is initially supplied with a signal I(l) where l ϵ[1; L], for example previously decoded as indicated above with reference to FIG. 6. The arrangement of the virtual speakers may concern a multi-channel representation or also a surround-sound representation of signals I(l) to be processed in order to render them together on a set of headphones CAS, in a spatialized manner with room effect (FIG. 6). For this purpose, typically there is applied to each signal a transfer function with room effect for each earpiece signal to be supplied $O^k$, with k=d (for the right), g (for the left). Thus, referring to FIG. 7, for each virtual speaker HPV we consider the acoustic path (ipsilateral TIL in the example shown) from the speaker HPV toward the left ear OG, and the acoustic path (contralateral TCL in the example shown) from the speaker HPV toward the right ear OD, as well as reflections on the walls MUR (path RIL), and finally a reverberant field after multiple reflections. At each reflection, the acoustic wave is considered to be attenuated in the highest frequencies.

Figure 3:
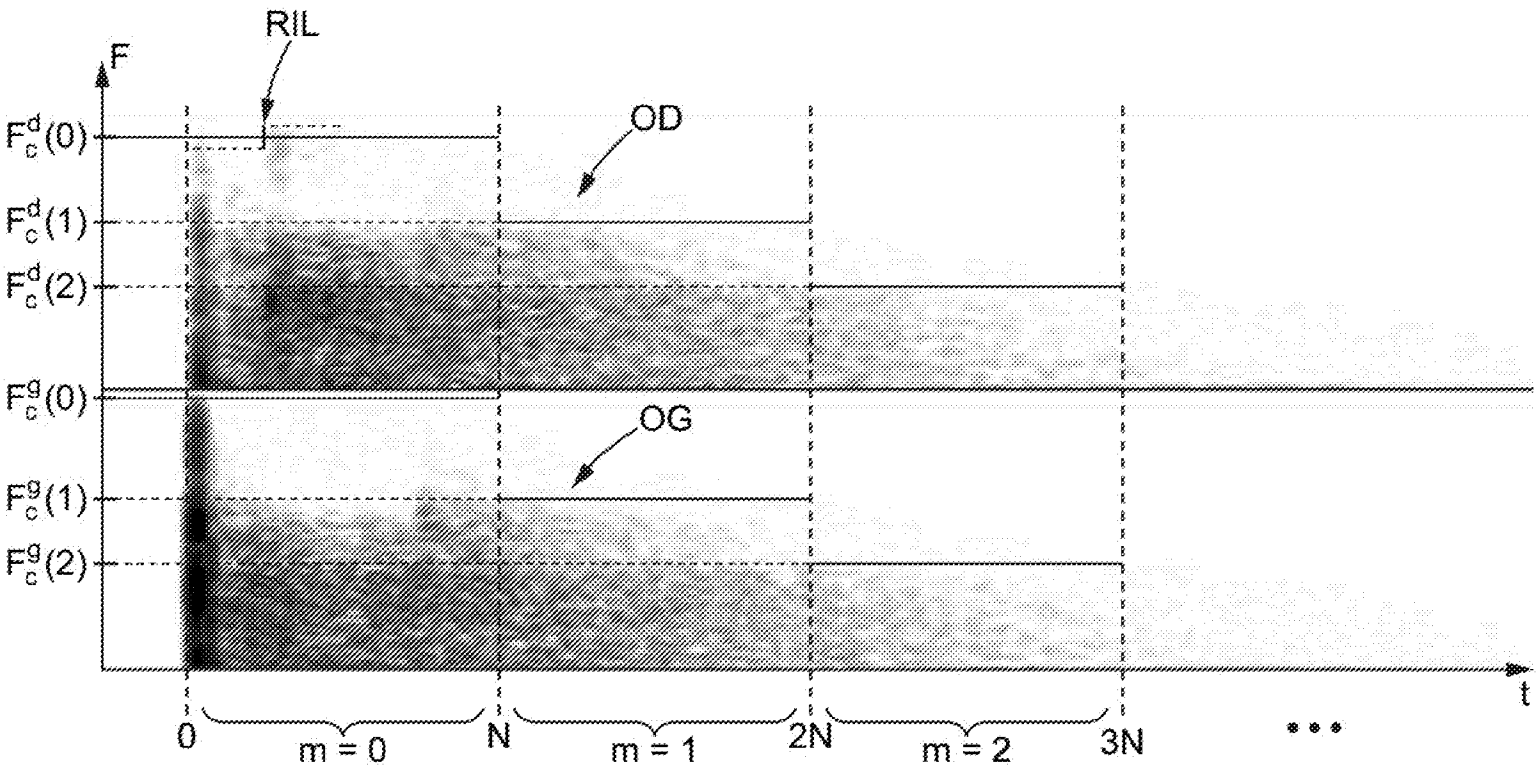
FIG. 3 shows an example of a time-frequency representation of a transfer function with variable cutoff frequencies (or the abovementioned "threshold frequencies"), in particular that are variable as a function of time.

Thus, referring to FIG. 3 concerning a time-frequency representation of a transfer function adapted for the virtual speaker HPV shown in FIG. 7, it is already apparent that the listener's head naturally lies in the contralateral path and the highest frequencies to be considered for the transfer function for the right ear OD are lower than those to be considered for the transfer function for the left ear OG (which is facing the virtual speaker HPV along an ipsilateral path). Thus, considering the first temporal block from 0 to N−1, denoted m=0, the maximum frequency $F_c^d(\mathbf{0})$ of a filter representing the transfer function for the right ear may be lower than the maximum frequency $F_c^g(\mathbf{0})$ of a filter representing the transfer function for the left ear. A developer of such a filter can thus limit the components of the filter for the right ear up to the cutoff frequency $F_c^d(\mathbf{0})$ (corresponding to a head screening frequency) even if the signal to be processed I(l) may have higher spectral components up to at least the frequency $F_c^g(\mathbf{0})$.

Then, after reflection, the acoustic wave tends to attenuate in the high frequencies, which does indeed occur in the time-frequency representation of the transfer function for the left ear, as well as for the right ear, for moments N to 2N−1, corresponding to the next block denoted m=1. Thus, a developer of filters representing these transfer functions can limit the components of filters for the right ear up to the cutoff frequency $F_c^d(\mathbf{1})$ and for the left ear up to the cutoff frequency $F_c^g(\mathbf{1})$. In an embodiment illustrated in particular in FIG. 5, we can consider that in block m=1, the transfer function typically characterizes the reverberant field for the right ear and for the left ear, and thus it can be established (possibly but this is non-limiting) that $F_c^d(\mathbf{1})=F_c^g(\mathbf{1})$.

Then, in the presence of the reverberant field with general attenuation of sound ("fade out"), the acoustic wave tends to be more attenuated at the high frequencies, which does indeed occur in the time-frequency representation of the transfer function for the left ear as well as for the right ear in FIG. 3, for instants 2N to 3N−1, corresponding to the block denoted m=2. Thus, a filter developer representing these transfer functions can limit the components of filters for the right ear to cutoff frequency $F_c^d(\mathbf{2})$ and for the left ear to cutoff frequency $F_c^g(\mathbf{2})$.

It should be noted that shorter blocks would allow more precise variation of the highest frequency to be considered, for example in order to take into account a first reflection RIL for which the highest frequency increases for the right ear (dotted lines around $F_c^d(\mathbf{0})$ in FIG. 3) in the first moments of block m=0.

We thus see that it is possible not to take into account all spectral components of a filter representing a transfer function, in particular beyond a cutoff frequency $F_c$. It is therefore advantageous to process the application of the transfer function in the spectral range. Convolution of a signal I(/) by a transfer function becomes, in the spectral range, a multiplication of the spectral components of the signal I(/) by the spectral components of the filter representing the transfer function in the spectral range, and, in particular, this multiplication can be carried out up to a cutoff frequency only, which is a function of a given block for example, and of the signal to be processed.

Thus, referring to FIG. 1, L input signals I(1), I(2), . . . , I(L) are transformed into the frequency domain in respective steps TF11, TF12, . . . , TF1L. Alternatively, such input signals may already be available in frequency form (for example in the decoder).

In step BA11, a complete spatialization impulse response (typically BRIR—"Binaural Room Impulse Response") in temporal form corresponding to signal I(1) from channel 1 is stored in memory. In step TFA11, this impulse response is transformed to frequency form in order to obtain a corresponding filter in the spectral range. In one advantageous embodiment, the filter is stored in its spectral form to avoid repeating the transform calculation. Then this filter is multiplied by the input signal in frequency form from channel 1 (which is equivalent to a convolution in the time domain). We thus have the spatialized signal for signal I(1) from channel 1.

The same operations are performed for the L−1 other channels. We thus have a total of L spatialized channels. These channels are then summed to obtain a single output signal representative of the L channels, and we return to the time domain in step ITF11 in order to output one of the signals $O^k$ (where k=d,g) supplied to an earpiece. Similar processing is performed for the other earpiece. In one embodiment described in detail below with reference to FIGS. 2 and 5, the L spatialized channels are not accessible independently before summation: the single output signal is constructed by progressively summing each spatialized channel with the previous output signal.

These operations are performed for each output signal $O^k$ to be constructed. In a binaural reproduction, these steps are typically carried out twice, once for the output signal to be supplied to the left earpiece of a headset and once for the output signal to be supplied to the right earpiece of the headset. We thus ultimately obtain two spatialized signals $O^d$ and $O^g$, each corresponding to an ear.

The L input signals may typically correspond to the L channels of multichannel audio content intended to be supplied to ("virtual") speakers. The L input signals may, for example, correspond to the L surround-sound signals of audio content in a surround-sound representation.

Figure 2:
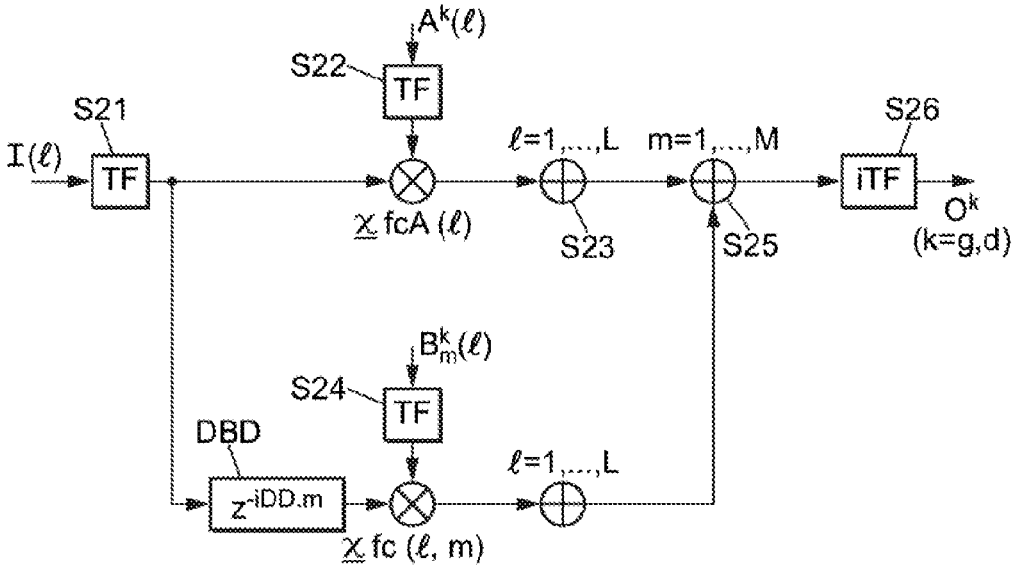
FIG. 2 illustrates an application of the method according to an embodiment in which the transfer functions are in the form of a combination of two transfer functions, one of them applied after a delay to the signal to be processed.
Figure 5:
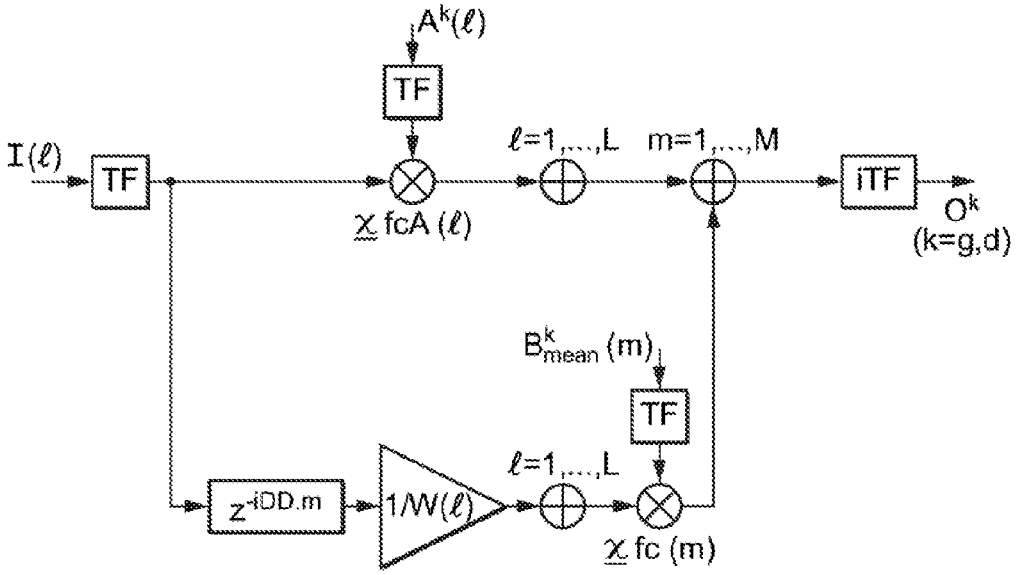
FIG. 5 shows a particular embodiment resulting from the mode represented in FIG. 2, but for more than two successive temporal blocks, with the transfer function $B_{mean}^{k}$ (m) representing the reverberant field changing as a function of the blocks m.

Referring now to FIG. 2 which illustrates an implementation in the sense of the invention, we again visit the principle of spatialization of L channels as presented in FIG. 1. The presentation in FIG. 2 is simplified, however, with the L input signals combined into a single line I(l). Thus, L input signals I(1), I(2), . . . , I(L) are transformed into the frequency domain in step S21. As indicated above, such input signals may alternatively be already available in frequency form. In step S22, an impulse response $A^k(l)$ from spatialization (typically BRIR-type) corresponding to signal I(l) of channel l is transformed into the spectral range in order to obtain a frequency filter. This impulse response $A^k(l)$ is incomplete in the representation in FIG. 2 because it corresponds to a first temporal block of samples m=0. As indicated above, this impulse response may already be available in frequency form. The components of this filter are then multiplied with the spectral signal of the corresponding channel I(l). This multiplication is configured (as indicated below with reference to FIG. 4) so that some frequency components are ignored, in the sense of the invention. Typically, the highest frequency components are ignored in order to reduce computational complexity. In FIGS. 2 and 5, the multiplication of components limited to a cutoff frequency is denoted by the symbol: x A cutoff frequency $f_{cA(l)}$ is defined, beyond which the frequency components are ignored (for example the maximum frequency represented in the signal of channel I(l), or half its sampling frequency). In addition, this cutoff frequency is specific to each filter and for each block (for example it decreases for blocks m=1, m=2). As the filters here are specific to each input signal and to each ear, a cutoff frequency is specific to an input signal, to an ear (and therefore to an output signal), and to a temporal block.

We then have the spatialized signal for channel l for the first temporal block. These operations are carried out for all L channels: l=1, . . . , L. This provides L spatialized channels. These channels are then summed in step S23 to obtain a single signal representing the L channels in the first temporal block.

In practice, the summation is carried out in a specific manner, to allow for a delay in the channels to characterize reverberations (reflections and reverberant field), as detailed below. Indeed, in one embodiment, the L spatialized channels are not accessible independently before summation: the single output signal is constructed by progressively summing each spatialized channel with the previous output signal. To this end, in step DBD, the input signals I(l) are delayed by a delay, given by $z^{-iDD\cdot m}$, specific to each block m=1, . . . , M. One will note that the delay m is zero for the first block. In the case of a frequency representation, this delay generally corresponds to the size of a signal frame processed for the first block, and is interpreted as the act of taking the previous input block in its frequency form.

In step S24, an incomplete impulse response $B_m^k(l)$ from spatialization (typically BRIR-type) corresponding to signal I(l) of channel l is converted into the spectral range in order to obtain a frequency filter. This impulse response $B_m^k(l)$ is incomplete because it corresponds to a second temporal block of samples (then to a third block and so on, for m=1, . . . , M). As indicated above, as a variant this impulse response may already be available in frequency form. Applying the principle described in document FR13 57299, it is possible to reduce processing complexity by positing $B_m^k(1)= \ldots =B_m^k(l)= \ldots =B_m^k(L)=B_{mean}^k(m)$ and to have this transfer function ultimately dependent only on the block m concerned (primary reverberant field, or secondary reverberant field with "fade out" attenuation) and on the ear k. Similarly, the reverberant field is not dependent on the channels and it is possible to set the cutoff frequency $f_c$ to be identical for each channel (but which can still decrease from one block to the next, as was seen earlier with reference to FIG. 3). This embodiment is presented in FIG. 5.

Referring again to FIG. 2, this filter $B_m^k(l)$ is then multiplied with signal I(l) of channel I. The cutoff frequencies are different for this second temporal block. As discussed with reference to FIG. 3, measurements show that the high frequencies are more attenuated in the more distanced temporal blocks (corresponding to reverberant sounds and multiple reverberations). The cutoff frequencies for these more distanced blocks can therefore be lower than for the first blocks. The lower the cutoff frequency, the more the number of operations is reduced. The complexity of the calculations is thus advantageously reduced.

The same operations are carried out for the L channels, and we repeat the operations of multiplying the filter with the progressively delayed spectral signals, summing the contributions in step S25 for each delay m until we obtain a single signal representing the L channels over the set M of temporal blocks m considered. The single output signal is constructed by progressively summing each spatialized channel with the previous output signal, as will now be discussed with reference to FIG. 4.

Lastly, we return to the time domain in step S26 in order to obtain an output signal to be supplied to one of the headset earpieces.

Figure 4:
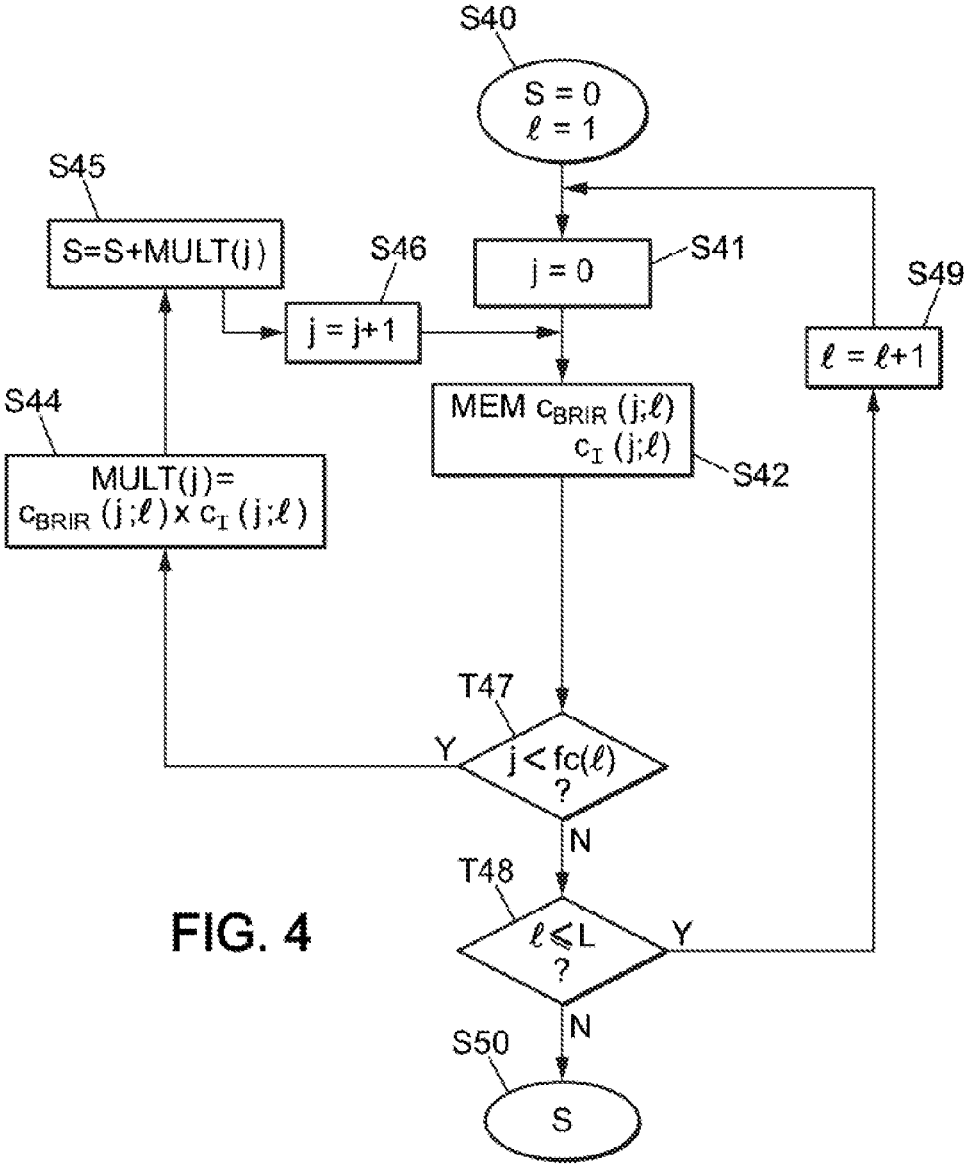
FIG. 4 illustrates a flowchart corresponding to a possible general algorithm for the computer program in the sense of the invention.

Referring to FIG. 4, we now describe a spatialization method for a given temporal block (for example the block representing the direct sound field with values in time interval [0; N−1]) and for a signal corresponding for example to the right ear. Of course, the same method is applied for the signal corresponding to the left ear. The distinction between the two ears is introduced by applying filters specific to each ear.

In step S40, the output signal S is initialized to 0. This output signal is expressed in the frequency domain. It is of limited size, of a length greater than the cutoff frequency fc(l). For example, this signal is defined for [0; fs(l)/2], fs(l) being the sampling frequency of this signal I(l). A first count variable l is also initialized to 1. This first count variable identifies one of the channel signals I(1), I(2), . . . , I(l), I(L) in temporal block [0; N−1] for the right ear. In step S41, a second count variable j is initialized to 0. This second count variable identifies a frequency component of a signal I(l) in temporal block [0; N−1] for the right ear.

In step S42, coefficient $c_{BRIR}(j;l)$ is stored in memory. This coefficient corresponds to frequency component j of filter BRIR(l) in temporal block [0; N−1] for the right ear. Similarly, coefficient $c_i(j;l)$ is stored in memory. This coefficient corresponds to frequency component j of signal I(l) in temporal block [0; N−1] for the right ear. Thus, coefficients $c_{BRIR}(j;l)$ and $c_i(j;l)$ correspond to the same frequency component (identified by variable j) and therefore can subsequently be multiplied term by term (step S44).

In test T47, we check whether the frequency corresponding to variable j is less than (for example strictly less than) the cutoff frequency fc(l). This cutoff frequency corresponds to the cutoff frequency of signal I(l) for temporal block [0;

N−1] for the right ear. If the frequency j is less than the cutoff frequency fc(l), we go to step S44.

In step S44, a value MULT(j) corresponding to the multiplication of coefficients $c_{BRIR}(j;l)$ and $c_i(j;l)$ is calculated. These coefficients are multiplied term by term because they correspond to the same frequency component j (for the same channel, in the same block, and for the same ear).

In step S45, this value MULT(j) is incrementally added to signal Sat the position of frequency j.

A signal S is thus constructed step by step, said signal comprising (at the end of the loop of length fc(l)) all frequency components up to the cutoff frequency fc(l) (for this signal I(l), in block [0, N−1], and for a right ear). Because when the loop begins in FIG. 4 we already have all the components initialized to 0, at the end of the loop a buffer (initially zero) has been filled up to the cutoff frequency, successively constructing the signal S. Each multiplication MULT(j) of coefficients is thus added step by step to the signal S being constructed.

In step S46, the variable j is incremented and we return to step S42. If the variable j is greater than (for example or equal to) the cutoff frequency fc(l), we advance to test T48. The signal S is thus filled in for the interval [0; fc(l)].

As stated above, this signal may be defined for a larger interval than [0; fc(l)] (for example [0; fs(l)/2]). In addition, the entire defined interval of this signal has been initialized to 0. Therefore, the unfilled remainder of the interval (for example [fc(l); fs(l)/2]) is still zero. This improves the complexity, because some steps of filling in the signal S have not been performed, which reduces the number of necessary calculations.

In test T48, we check whether the count variable l corresponding to signal I(l) of channel l is less than (for example strictly less than) the number L of channels. If the variable l is less than or equal to L, the variable l is incremented in step S49 and the method returns to step S41. If the variable l is greater than L, the signal S corresponding to the spatialized signal for temporal block [0; N 1] for the right ear is available in step S50.

This signal S corresponding to temporal block [0; N−1] is then summed with other similarly generated signals for other temporal blocks [N; 2N−1], [2N; 3N−1], etc., (and to which a suitable delay has been applied in accordance with step DBD above in FIG. 2 for example).

Typically, to construct block [N; 2N−1], we apply in the frequency domain a filter corresponding to a transfer function common to all input signals I(l), representing the reverberant field, with a cutoff frequency fc in the multiplication of spectral components that corresponds to the minimum between:

- a reverberant field maximum frequency Fc (reverberant) as illustrated in FIG. 3 described above (for example selected between 10 to 15 kHz for block m=1 and between 5 to 10 kHz for block m=2), and
- the maximum frequency fmax represented in each input signal (for example its sampling frequency or the maximum frequency for which the spectral component is not zero, this value typically being given by a compression decoder).

Note that the frequency multiplication, which stops at a given cutoff frequency (which is mathematically equivalent to multiplying by 0 beyond that point), is not trivial for the skilled person. Indeed, in a context of filtering an audio signal, this type of very aggressive low-pass filter generally yields audible aliasing artifacts, due to echo or pre-echo phenomena resulting from the time aliasing generated by the circular convolution, which it is generally desirable to avoid. However, in the context of the invention, the low-pass filter is not applied to the sound signal but to the BRIR filter (itself convolved with the sound signal) which is already composed of multiple reflections; the artifacts produced will therefore at worst be perceived as additional reflections of the original BRIR filter, and in practice are rarely noticeable. It is nevertheless possible to mitigate these artifacts by slightly modifying the frequencies of the filter preceding the cutoff frequency (for example mild attenuation by applying a half-Hanning window (fade out type)).

In general, with reference to FIG. 4, one will note that two operations are carried out in a same loop instance (typically one clock cycle): the multiplication MULT(k) and its addition to the output signal S. This allows implementing this method on processors that have the ability to perform several operations during a single loop instance (typically one clock cycle), thereby reducing the time required for the calculations.

Illustrated in FIG. 5 is a complete algorithmic form of the processing, according to the formula presented above which yields an output signal $O^k$:

$$O^k = \sum_{l=1}^{L} \left(I(l) *_{[0;\ldots;f^k(l)]} A^k(l)\right) + \sum_{m=1}^{M} \left(z^{-iDDm} \cdot G(I(l)) \cdot \sum_{l=1}^{L} \left(\frac{1}{W^k(l)} \cdot I(l)\right)\right) *_{[0;\ldots;f^k(m)]} B^k_{mean}(m)$$

As indicated above, the weighting factors $W^k(l)$ and the gains G(I(l)) may be fixed at 1. The gains G(I(l)) have not been represented in FIG. 5, as this figure should be read as an integration of the gains at weights $1/W^k(l)$. In addition, during the design of the filters, these two parameters are determined, fixed, and multiplied together once and for all.

The invention claimed:

1. A method for sound spatialization, comprising the application of at least one transfer function with room effect to at least one sound signal, said application amounting to multiplying, in the spectral range, spectral components of the sound signal by the spectral components of a filter corresponding to said transfer function, each spectral component of the filter having a temporal variation in a time-frequency representation, wherein said spectral components of the filter are ignored, for said multiplications of components, beyond a threshold frequency and after at least a given instant in said time-frequency representation, and wherein, for an implementation by a sound spatialization module receiving a plurality of input signals and providing at least two output signals, in order to provide each output signal, a transfer function with room effect is applied to each input signal, each of said output signals being given by applying a formula of the type:

$$O^k = \sum_{l=1}^{L} \left(I(l) *_{[0;\ldots;f^k(l)]} A^k(l)\right) + \sum_{m=1}^{M} \left(z^{-iDDm} \cdot G(I(l)) \cdot \sum_{l=1}^{L} \left(\frac{1}{W^k(l)} \cdot I(l)\right)\right) *_{[0;\ldots;f^k(m)]} B^k_{mean}(m)$$

$O^k$ being an output signal, and k being the index relating to an output signal, $l \in [1; L]$ being the index relating to an input signal among said input signals, L being the number of input signals, and I(l) being an input signal among said input signals, $A^k(l)$ being a transfer function with room effect, specific to an input signal, $B_{mean}^k(m)$ being a general transfer function, with room effect, common to the input signals, $W^k(l)$ being a selected weighting factor, and G(I(l)) being a predetermined power compensation gain, $z^{-iDDm}$ being an application of a delay, counted as the number of blocks of samples, corresponding to a time difference between emission of a sound in a room corresponding to the room effect, and the beginning of the presence of the reverberant field in said room, the index m corresponding to a number of blocks of samples of a duration corresponding to this delay, M being the total number of blocks that a transfer function lasts in a time-frequency representation, the symbol "." designating multiplication, the term "*[0; . . . ; $f^k(l)$]" designating the convolution operator on a limited number of frequencies and ranging from a lowest frequency to a maximum frequency $f^k(l)$ which is a function of at least the input signal of index l, and the term "*[0; . . . ; $f^k(m)$]" designating the convolution operator on a limited number of frequencies and ranging from a lowest frequency to a frequency $f^k(m)$ which is a function of the block of samples of index m.

2. The method according to claim 1, wherein the threshold frequency decreases over time in said time-frequency representation.

3. The method according to claim 1, wherein information is obtained about the spectral component of highest frequency in the sound signal, and wherein said threshold frequency is the minimum between a predetermined threshold frequency and said highest frequency.

4. The method according to claim 3, wherein the sound signal originates from a compression decoder and the information about the spectral component of highest frequency is provided by the decoder.

5. The method according to claim 3, wherein the sound signal is sampled at a given sampling frequency, said threshold frequency being selected based on said sampling frequency.

6. The method according to claim 1, wherein the sound signal is spatialized on at least first and second virtual speakers respectively associated with a first and a second channel, and first and second transfer functions with room effect are respectively applied to said first and second channels, one among the first and second transfer functions applying an ipsilateral acoustic path effect, and the other among the first and second transfer functions applying a contralateral acoustic path effect, with elimination of spectral components of the sound signal beyond a given screening frequency, and wherein said threshold frequency for the transfer function applying a contralateral path effect is the minimum between a predetermined threshold frequency and said screening frequency.

7. The method according to claim 1, wherein the signals comprise successive blocks of samples, of the same size between signals, and wherein said at least one given instant is temporally located at the beginning of a block that is different from a first block in a sequence of blocks.

8. A non-transitory computer-readable storage medium with an executable program stored thereon, wherein the program instructs a microprocessor to perform the method according to claim 1.

9. A sound spatialization module, comprising a processor for applying at least one transfer function with room effect to at least one input sound signal, said application amounting to multiplying, in the spectral range, spectral components of the sound signal by the spectral components of a filter corresponding to said transfer function, each spectral component of the filter having a temporal evolution in a time-frequency representation, wherein the processor is configured to ignore said spectral components of the filter for said multiplications of components, beyond a threshold frequency and after at least a given instant in said time-frequency representation, and the sound spatialization module, receiving a plurality of input signals, provides at least two output signals, the processor being configured to apply a transfer function with room effect to each input signal, each of said output signals being given by applying a formula of the type:

$$O^k = \sum_{l=1}^{L} \left( I(l) *_{[0;\ldots;f^k(l)]} A^k(l) \right) + \sum_{m=1}^{M} \left( z^{-iDDm} \cdot G(I(l)) \cdot \sum_{l=1}^{L} \left( \frac{1}{W^k(l)} \cdot I(l) \right) \right) *_{[0;\ldots;f^k(m)]} B_{mean}^k(m)$$

$O^k$ being an output signal, and k being the index relating to an output signal, $l \in [1; L]$ being the index relating to an input signal among said input signals, L being the number of input signals, and I(l) being an input signal among said input signals, $A^k(l)$ being a transfer function with room effect, specific to an input signal, $B_{mean}^k(m)$ being a general transfer function, with room effect, common to the input signals, $W^k(l)$ being a selected weighting factor, and G(I(l)) being a predetermined power compensation gain, $z^{-iDDm}$ being an application of a delay, counted as the number of blocks of samples, corresponding to a time difference between emission of a sound in a room corresponding to the room effect, and the beginning of the presence of the reverberant field in said room, the index m corresponding to a number of blocks of samples of a duration corresponding to this delay, M being the total number of blocks that a transfer function lasts in a time-frequency representation, the symbol "." designating multiplication, the term "*[0; . . . ; $f^k(l)$]" designating the convolution operator on a limited number of frequencies and ranging from a lowest frequency to a maximum frequency $f^k(l)$ which is a function of at least the input signal of index l, and the term "*[0; . . . ; $f^k(m)$]" designating the convolution operator on a limited number of frequencies and ranging from a lowest frequency to a frequency $f^k(m)$ which is a function of the block of samples of index m.

* * * * *